US008939202B2

(12) United States Patent
Xu et al.

(10) Patent No.: US 8,939,202 B2
(45) Date of Patent: Jan. 27, 2015

(54) FRACTURING NOZZLE ASSEMBLY WITH CYCLIC STRESS CAPABILITY

(75) Inventors: Richard Yingqing Xu, Tomball, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 698 days.

(21) Appl. No.: 13/114,755

(22) Filed: May 24, 2011

(65) Prior Publication Data

US 2012/0298351 A1 Nov. 29, 2012

(51) Int. Cl.

| | |
|---|---|
| ***E21B 7/18*** | (2006.01) |
| ***E21B 43/26*** | (2006.01) |
| ***E21B 41/00*** | (2006.01) |

(52) U.S. Cl.

CPC ..... *E21B 43/26* (2013.01); *E21B 41/0078* (2013.01)

USPC ..... 166/223; 166/308.1; 166/222; 175/424

(58) Field of Classification Search

CPC ..... E21B 7/18; E21B 43/114; E21B 10/60; E21B 43/26; E21B 10/61; E21B 41/0078; E21B 10/18; B26F 3/004; B05B 3/06; B24C 5/04

USPC ..... 166/308.1–308.6, 177.1, 271, 222, 223; 175/424

See application file for complete search history.

(56) References Cited

U.S. PATENT DOCUMENTS

| | | | | |
|---|---|---|---|---|
| 4,050,529 | A * | 9/1977 | Tagirov et al. | 175/424 |
| 4,687,066 | A * | 8/1987 | Evans | 175/340 |
| 4,739,845 | A * | 4/1988 | Dennis | 175/393 |
| 4,787,465 | A * | 11/1988 | Dickinson et al. | 175/67 |
| 4,819,745 | A | 4/1989 | Walter | |
| 4,852,668 | A * | 8/1989 | Dickinson et al. | 175/67 |
| 5,111,881 | A | 5/1992 | Soliman et al. | |
| 5,335,724 | A | 8/1994 | Venditto et al. | |
| 5,484,016 | A | 1/1996 | Surjaatmadja et al. | |
| 5,494,103 | A | 2/1996 | Surjaatmadja et al. | |
| 5,499,678 | A | 3/1996 | Surjaatmadja et al. | |
| 5,533,571 | A | 7/1996 | Surjaatmadja et al. | |
| 5,765,756 | A * | 6/1998 | Jordan et al. | 239/204 |
| 6,263,984 | B1 * | 7/2001 | Buckman, Sr. | 175/67 |
| 6,626,253 | B2 | 9/2003 | Hahn et al. | |
| 6,662,874 | B2 | 12/2003 | Surjaatmadja et al. | |
| 6,719,054 | B2 | 4/2004 | Cheng et al. | |
| 6,725,933 | B2 | 4/2004 | Middaugh et al. | |
| 6,779,607 | B2 | 8/2004 | Middaugh et al. | |
| 6,938,690 | B2 | 9/2005 | Surjaatmadja et al. | |
| 7,017,665 | B2 | 3/2006 | Nguyen | |
| 7,159,660 | B2 | 1/2007 | Justus | |
| 7,225,869 | B2 | 6/2007 | Willett et al. | |

(Continued)

*Primary Examiner* — Shane Bomar

*Assistant Examiner* — Kipp Wallace

(74) *Attorney, Agent, or Firm* — Steve Rosenblatt

(57) ABSTRACT

A fracturing jet nozzle assembly features a series of angles nozzles on a rotatably mounted plate that operates in conjunction with a central nozzle or nozzles. The slanted nozzles are aimed into the perforation where the central nozzle is aimed directly so that the rotation of the nozzle plate from the slanted nozzles results in cyclic impacts in the perforation from where the fractures will propagate. The cyclic loading results in greater fracture formation and propagation. In another variation, relatively movable plates employing slanted nozzles rotate one plate with respect to another to get the effect of cyclic pulses of jetting fluid impingement in the perforation to enhance formation and propagation of fractures from the perforation.

20 Claims, 4 Drawing Sheets

(56) References Cited

U.S. PATENT DOCUMENTS

| | | | | |
|---|---|---|---|---|
| 7,237,612 | B2 | 7/2007 | Surjaatmadja et al. | |
| 7,278,486 | B2 | 10/2007 | Alba et al. | |
| 7,337,844 | B2 | 3/2008 | Surjaatmadja et al. | |
| 7,343,974 | B2 | 3/2008 | Cowan | |
| 7,681,635 | B2 | 3/2010 | Farabee et al. | |
| 8,544,567 | B2 * | 10/2013 | Comeau et al. | 175/340 |
| 2008/0083531 | A1 | 4/2008 | Surjaatmadja | |
| 2009/0107680 | A1 | 4/2009 | Surjaatmadja | |
| 2009/0283260 | A1 | 11/2009 | Surjaatmadja et al. | |
| 2009/0288833 | A1 * | 11/2009 | Graham et al. | 166/306 |
| 2011/0011648 | A1 * | 1/2011 | Paul et al. | 175/424 |

* cited by examiner

FRACTURING NOZZLE ASSEMBLY WITH CYCLIC STRESS CAPABILITY

FIELD OF THE INVENTION

The field of the invention is nozzles used in formation fracturing and more particularly nozzles used to enhance the initiation and propagation of formation fractures by adding a feature of cyclical impingement to the initial perforation made by the nozzle assembly.

BACKGROUND OF THE INVENTION

Fracturing in open hole is a complex subject and has been studied and written about by various authors. Whether using explosives or fluid jets one of the problems with the initiated fractures is in the way they propagate. If the propagation pattern is more tortuous as the fractures emanate from the borehole an undesirable condition called screenout can occur that can dramatically decrease the well productivity after it is put on production.

Hydraulically fracturing from any borehole in any well orientation is complex because of the earth's ambient stress field operating in the area. This is complicated further because of the extreme stress concentrations that can occur along the borehole at various positions around the well. For instance, there are positions around the borehole that may be easier to create a tensile crack than other positions where extreme compressive pressures are preventing tensile failure. One way that has been suggested to minimize this condition is to use jets that create a series of fan shaped slots in the formation with the thinking that a series of coplanar cavities in the formation will result in decreased tortuosity. This concept is discussed in SPE 28761 Surjatmaadja, Abass and Brumley Elimination of Near-wellbore Tortuosities by Means of Hydrojetting (1994). Other references discus creating slots in the formation such as U.S. Pat. Nos. 7,017,665; 5,335,724; 5,494,103; 5,484,016 and U.S. Publication 2009/0107680.

Other approaches oriented the jet nozzles at oblique angles to the wellbore to try to affect the way the fractures propagated. Some examples of such approaches are U.S. Pat. Nos. 7,159,660; 5,111,881; 6,938,690; 5,533,571; 5,499,678 and U.S. Publications 2008/0083531 and 2009/0283260.

Other approaches involved some form of annulus pumping in conjunction with jet fracturing. Some examples of this technique are U.S. Pat. Nos. 7,278,486; 7,681,635; 7,343,974; 7,337,844; 7,237,612; 7,225,869; 6,779,607; 6,725,933; 6,719,054 and 6,662,874.

Pulsing techniques have been used in jet drilling or in conventional drilling to pulse the bit nozzle flow as described in U.S. Pat. Nos. 4,819,745 and 6,626,253. Also related to these applications is SPE paper 130829-MS entitled *Hydraulic Pulsed Cavitating Jet Assisted Deep Drilling: An Approach to Improve Rate of Penetration.*

Jets mounted to telescoping assemblies have been suggested with the idea being that if the jet is brought closer to the formation the fracturing performance will improve. This was discussed in U.S. application Ser. No. 12/618,032 filed Nov. 13, 2009 called Open Hole Stimulation with Jet Tool and is commonly assigned to Baker Hughes Inc. In another variation of telescoping members used for fracturing the idea was to extend the telescoping members to the borehole wall and to set spaced packers in the annulus so as to avoid the need to cement and to allow production from the telescoping members after using some of them to initially fracture the formation. This was discussed in U.S. application Ser. No. 12/463, 944 filed May 11, 2009 and entitled Fracturing with Telescoping Members and Sealing the Annular Space and is also commonly assigned.

The present invention seeks to improve the extent of the fracturing that is accomplished beyond the initial formation perforation that is initiated explosively or with a direct impingement nozzle. The concept is to cyclically bombard the perforation with a jet stream or streams. This is accomplished in several ways including rotationally mounting a spray plate with angled spray exit streams that induce the plate to rotate on its axis. A specific location within the perforation will then by cyclically impinged and then after a pause will be impinged again. Another way is a combination of a stationary and rotating plate to create pulsing jet streams that further extend fractures that initiate in a perforation or from jet impingement in a normal direction. These and other aspects of the present invention will be more readily apparent to those skilled in the art from a review of the specification and the associated drawings while recognizing that the full scope of the invention is to be determined from the appended claims.

SUMMARY OF THE INVENTION

A fracturing jet nozzle assembly features a series of angles nozzles on a rotatably mounted plate that operates in conjunction with a central nozzle or nozzles. The slanted nozzles are aimed into the perforation where the central nozzle is aimed directly so that the rotation of the nozzle plate from the slanted nozzles results in cyclic impacts in the perforation from where the fractures will propagate. The cyclic loading results in greater fracture formation and propagation. In another variation, relatively movable plates employing slanted nozzles rotate one plate with respect to another to get the effect of cyclic pulses of jetting fluid impingement in the perforation to enhance formation and propagation of fractures from the perforation.

DETAILED DESCRIPTION OF THE PREFERRED EMBODIMENT

Figure 1:
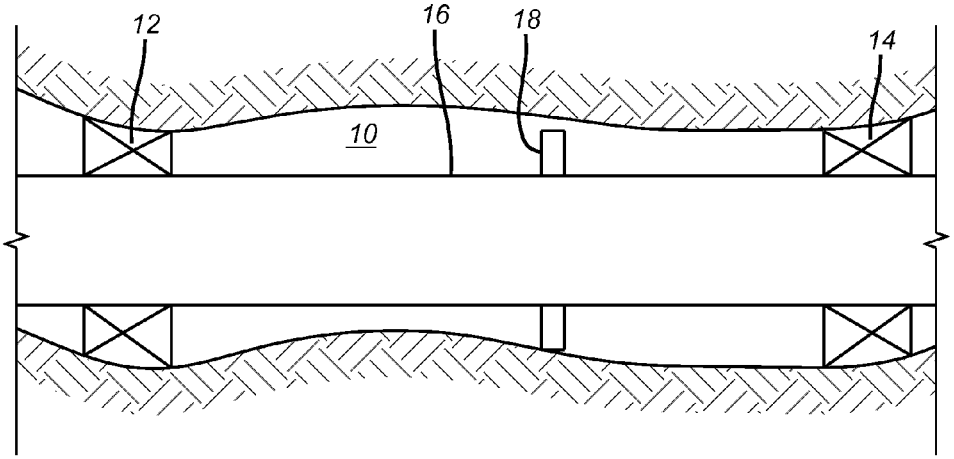
FIG. 1 is a schematic view of a zone to be fractured between barriers showing the placement of the nozzle assembly of the present invention.

FIG. 1 shows a zone 10 isolated by packers 12 and 14 and a string 16 spanning the packers 12 and 14 and extending to the surface where the source of pressurized fluid (not shown) is located on a rig at the well site. The assembly 18 which will be described in its various embodiments below is shown schematically as an array that extends circumferentially around the string 16 and can be in a single or multiple parallel rows or can be offset spirals at for example 90 degree spacing or the pattern can be random to secure good coverage of the jet streams in the zone 10. It is understood that there can be other zones and those skilled in the art will further know that the packer 12 can be set after the zone 10 is fractured to allow fracturing to go on at a higher zone that is not shown. In that case the packer 12 is set after zone 10 is fractured to allow isolation of zone 10 when another zone is being fractured.

Figure 2:
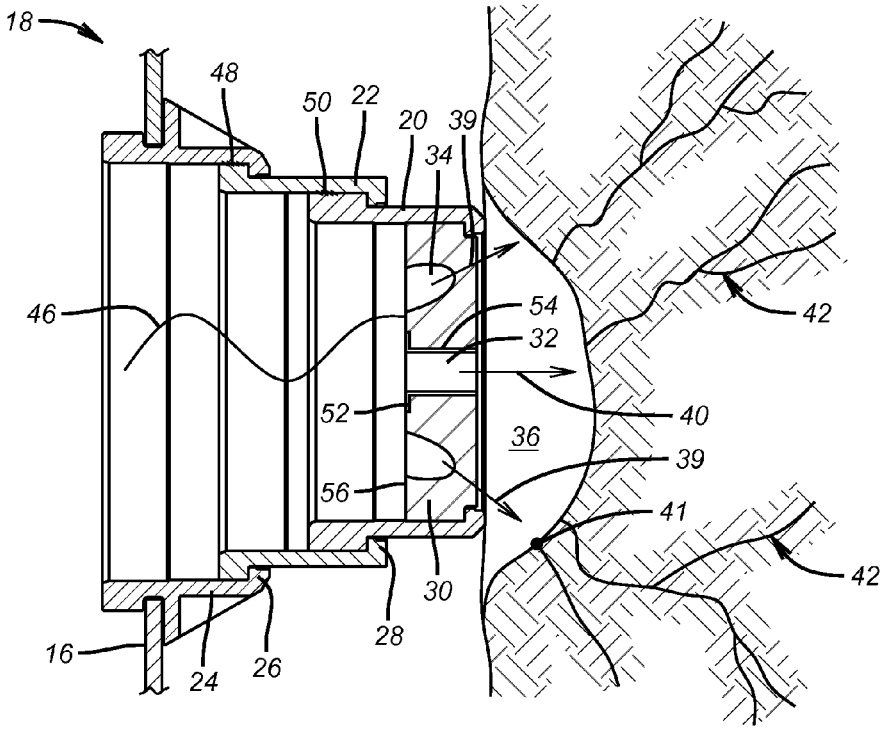
FIG. 2 is a section view of the extended nozzle assembly that has initiated a perforation and is creating and extending fractures into the formation.
Figure 3:
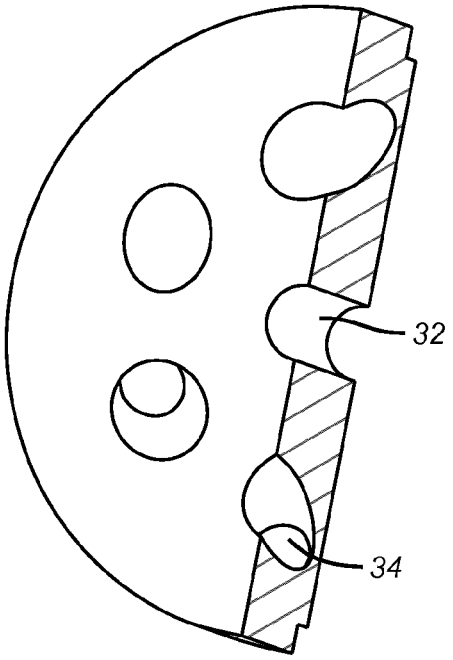
FIG. 3 is a perspective view of half the rotating nozzle plate showing the straight and the tilted nozzles.
Figure 4:
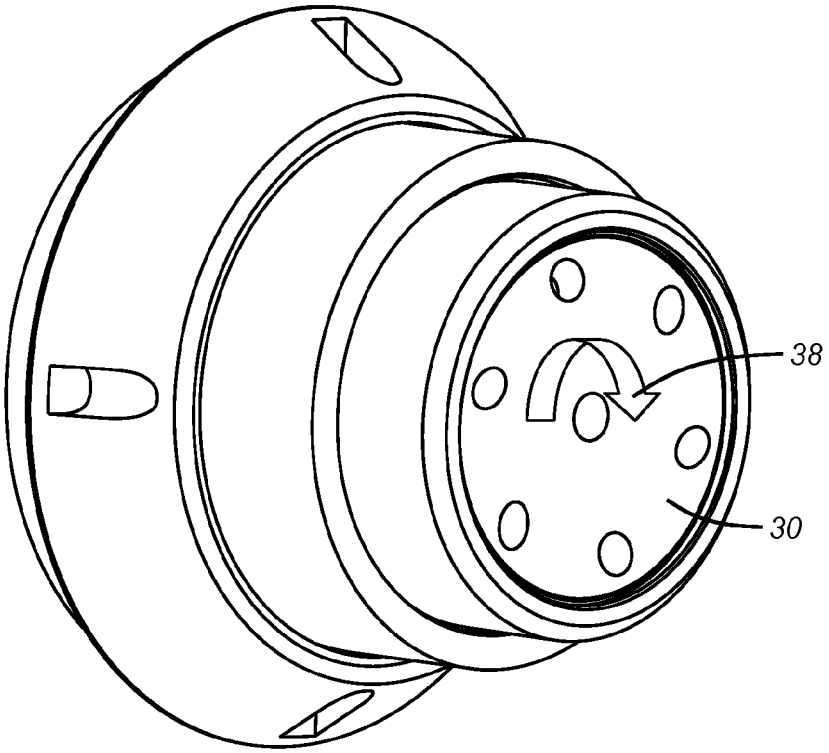
FIG. 4 is a perspective view of the assembly that is telescopingly extended and showing the rotating nozzle plate at the leading end.

The assembly 18 is shown in FIG. 2 as a series of movable components 20 and 22 that extend from a fixed component 24 attached to the wall of the string 16. Component 24 has a travel stop 26 that limits the outer extension of section 22. Similarly section 22 has its travel stop 28 for section 20. Within section 20 is a rotatably mounted plate 30 that has one or more centrally located nozzle openings 32 whose axis is on or parallel to the axis of the components 20 or 22. At an outer periphery are a series of nozzles 34 that have their axis skewed to the axis of components 22 and 20 at an angle that directs their stream into the pocket 36 that was initiated either explosively or by the jet stream from the nozzle openings 32. FIG. 4 shows that the plate 30 rotates because of the skew of openings 34 in one direction represented by arrow 38. The rotational direction can be reversed by simply flipping over the plate 30 or changing the skew angle of the openings 34 to induce rotation in the opposite direction.

The skew in the openings 34 directs the jets obliquely as shown by arrows 39 to the straight jet stream 40 coming from opening or openings 32. Additionally, because plate 30 is rotating, the same spot 41 for example does not get impacted with a constant stream but rather gets impacted cyclically as each nozzle 34 spins around and aligns with the spot 41. As a result of this cyclic impact pattern the more fractures 42 are initiated and propagated.

Figure 5:
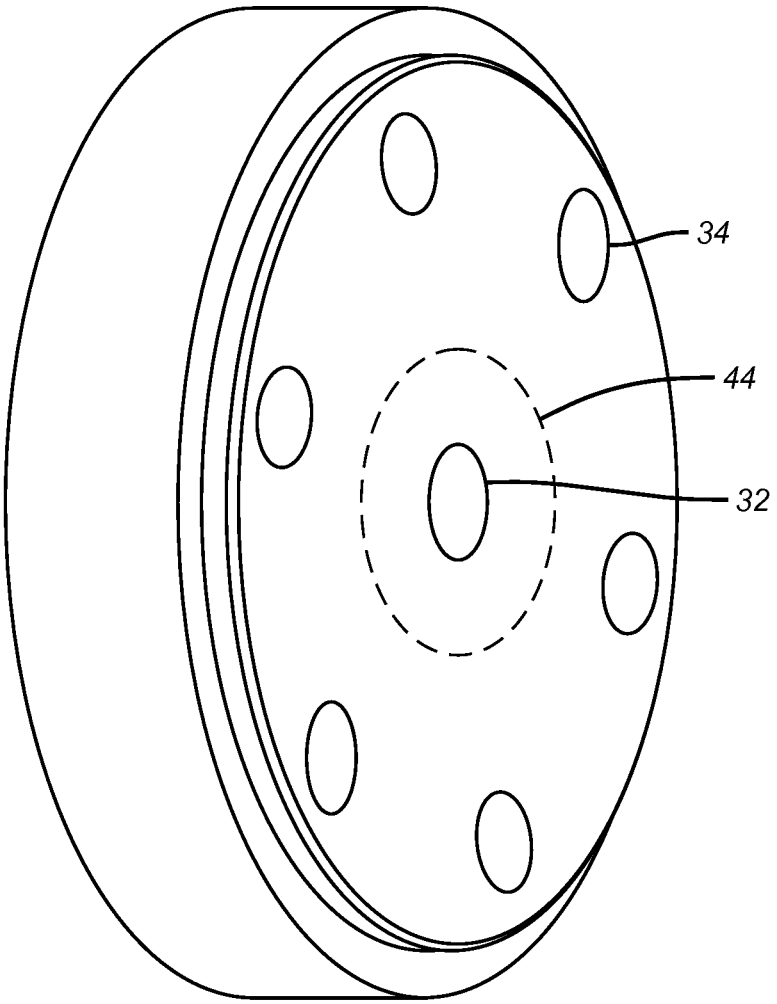
FIG. 5 is a similar view to FIG. 3 showing the rotating plate in perspective.

FIG. 5 illustrates a variation where the straight nozzles 32 are on a fixed segment denoted by dashed lines 44 and the nozzles or openings 34 that are skewed to cause rotation of the outer segment 46 that is able to rotate as its core with nozzles 32 is held fixed. The spacing of the nozzles 34 can be equal or unequal along a common circumferential line. The nozzles 34 can be in a single radial distance from the center of the plate 30 or in multiple concentric rows or in a random order on a common circumferential line or lines or other arrangements that will induce rotation of the plate 30. The angular orientation of each nozzle 34 with respect to the axis of components 20 or 22 can be the same for all or the skew angles can vary. The axis of the nozzles 34 can intersect the axis of the components 20 or 22 or preferably not so that there is a tangential component to induce spin even if the array of nozzles is symmetrical about the center of the plate 30. Optionally an inline mixer such as a screw shape shown schematically as 46 can be attached to the plate 30 and located within the components 20, 22 and 24 to further induce spinning of the plate 30 using the delivered fluid for an extra boost of rotational force beyond the reaction force of the fluid exiting the nozzles 34 at high velocity and on a skewed axis. Nozzles 32 may be optionally eliminated or themselves be oriented on a skew to the axis of components 20, 22 and 24. While the use of telescoping segments 20 and 22 is preferred to get the plate 30 as close as possible to the borehole wall as shown in FIG. 2 the assemblies 18 can also be fixed so that they do not telescope. As another option the extended position of FIG. 2 can be locked in at full extension or at partial extension if the borehole wall is encountered before full extension takes place. Ratchets 48 and 50 can be used to prevent retraction after any extension. The velocity of the fluid being pumped through the nozzles 32 and 34 will create an extension force to reach the FIG. 2 position from a collapsed position for run in. The plate 30 can be made entirely from a hard material such as tungsten carbide or in the alternative the nozzles can be formed with inserts in a softer plate 30 where the inserts are retained by internal flanges 52 attached to a sleeve 54 extending through the opening of the plate 30. Alternatively as shown in FIG. 2 the sleeve 56 can be secured in the wall that is plate 38 such as by threads or adhesives, for example.

Figure 6:
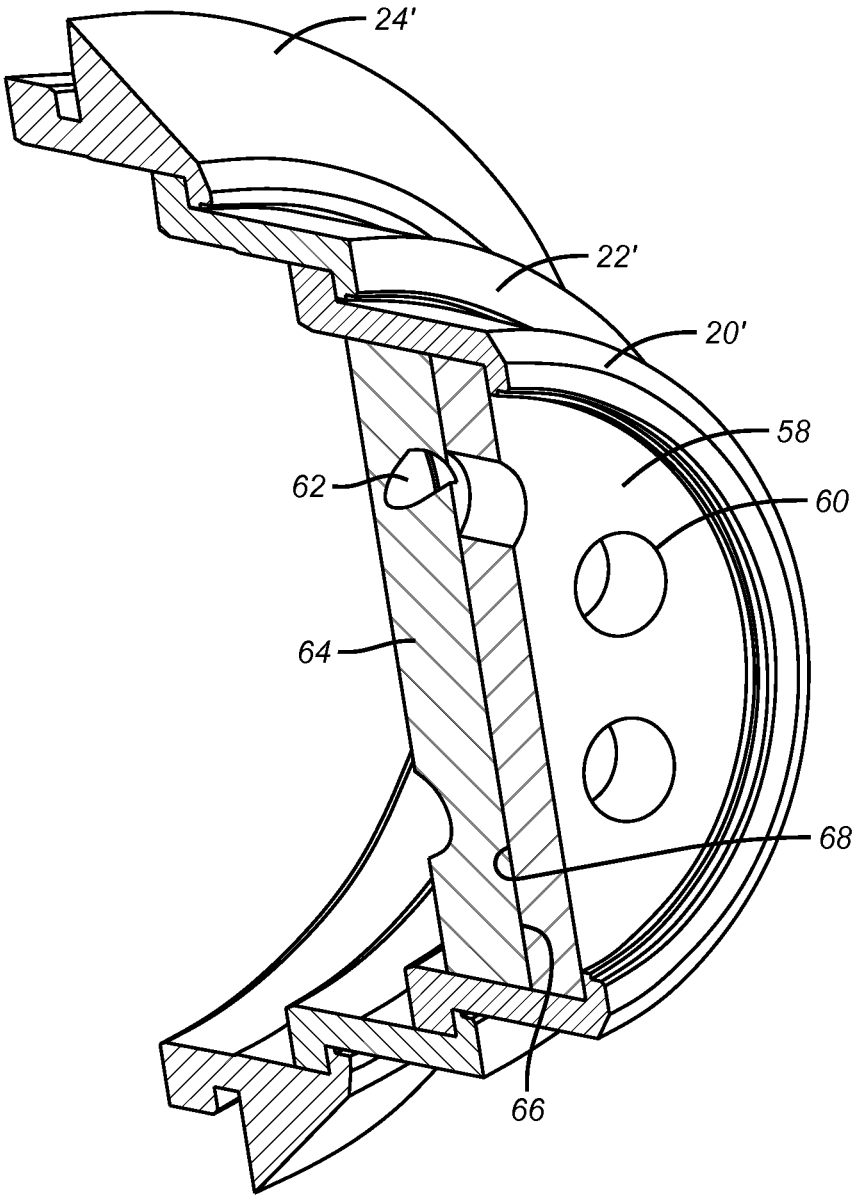
FIG. 6 is an alternative embodiment shown in perspective of a half section that uses a stationary plate at a leading end and a rotating plate behind it.

FIG. 6 shows a stationary plate 58 with openings 60 that can be oriented substantially parallel to the axis of components 20', 22' and 24'. Substantially parallel means in perfect parallel alignment to a 10 degree skew. Openings 62 are in rotatably mounted plate 64 and are similarly oriented as nozzles 34 in plate 30 described above. Preferably the openings 60 are larger than the openings 62 at face 66 of plate 64. The same options with regard to extending as described above apply to this embodiment as described above for the preferred embodiment. An optional internal mixer similar to 46 in FIG. 2 can also be fitted. In the FIG. 6 embodiment the nozzles equivalent to 32 in FIG. 2 are eliminated. The orientation of the nozzles 62 makes plate 64 spin and provides a pulsing flow through the openings 60. Openings 60 can be large enough so that they do not act as nozzles but rather as mere openings for passage of accelerated fluid flowing through nozzles 62. The orientation of the nozzles 62 with respect to the openings 60 is such that at any given time there is flow through the plate 64 to keep plate 64 spinning. Face 68 of plate 58 can be made of a hardened material to tolerate the erosive effects of impact of flowing fluid when the openings 62 are moving between openings 60. The nozzle construction variations for nozzles 62 are the same as for nozzles 34. The telescoping feature in the FIG. 6 design is optional as in the FIG. 2 design but a ratcheting telescoping design as shown is preferred.

The rotational movement of the nozzles helps to start and propagate fractures during the fracturing procedure by building on the perforations that are there from the perforating or the substantially parallel nozzles if they are used. The pulsing impacts on the borehole wall help to break up the rock and start and extend the fractures. The use of the energy of the flowing fluid to get the turning action keeps the design simple. More elaborate designs that mechanically drive the plate with the nozzles can be used but they would be more expensive and more prone to breakage. The rotating plate can be supported on a stationary bushing made of a soft metal or plastic or composite material. In the alternative more expensive ball or roller bearings can be used. The assembly can be extendable by force of the flow through the nozzles and the extended position can be locked in with a ratchet or body lock ring or some other device that allows relative movement in a single direction. The rotating plate can be a circular disc or it can be an annular shape that surrounds a stationary core where the core has substantially parallel oriented nozzles with respect to the axis of the assembly. The assembly can be in arrays on casing with parallel rows or offset spiral patterns or random locations in a desired zone to be fractured to assure adequate fracturing. While the preferred orientation of each assembly is perpendicular to the axis of the casing in which it is mounted, the assemblies can also be secured in a skewed orientation to the casing axis in a manner where the axis of the assembly 10 either passes through the axis of the tubular 16 or is offset from it.

The above description is illustrative of the preferred embodiment and many modifications may be made by those skilled in the art without departing from the invention whose scope is to be determined from the literal and equivalent scope of the claims below.

I claim:

1. A subterranean fracturing nozzle assembly mounted to a string that delivers pressurized fluid to a formation to be fractured, comprising:

at least one housing having an extendable passage therethrough that is in fluid communication with the string;

an axially and rotationally movably mounted member, respectively with and in said passage having at least one straight bore nozzle therethrough said nozzle orientated in said member to rotate said member as a result of fluid flow through said nozzle.

2. A subterranean fracturing nozzle assembly mounted to a string that delivers pressurized fluid to a formation to be fractured, comprising:

at least one housing having a passage therethough that is in fluid communication with the string;

a movably mounted member in said passage having at least one nozzle therethrough said nozzle orientated in said member to rotate said member as a result of fluid flow through said nozzle;

said housing having multiple telescoping components to allow said housing to telescope radially thereby allowing said member to move radially away from the string and toward the formation with tandem movement with said housing.

3. The assembly of claim 2, wherein:

said components are relatively movable in a single direction.

4. The assembly of claim 1, wherein:

said passage having an axis and said nozzle having a nozzle axis that is not parallel to said housing axis.

5. The assembly of claim 4, wherein:

said nozzle axis does not intersect said housing axis.

6. The assembly of claim 5, wherein:

said at least one nozzle comprises a plurality of nozzles disposed on at least one radius from a center of said member.

7. The assembly of claim 1, wherein:

said member rotates on a bushing or a bearing.

8. The assembly of claim 1, wherein:

said at least one housing comprises a plurality of housings arranged on the string in parallel rows that extend circumferentially or longitudinally, or circumferentially offset spiral arrays or a random ordering on the string.

9. The assembly of claim 1, wherein:

said passage comprises a device to impart spin to fluid passing said passage, said device supported by said member.

10. A subterranean fracturing nozzle assembly mounted to a string that delivers pressurized fluid to a formation to be fractured, comprising:

at least one housing having a passage therethrough that is in fluid communication with the string;

a movably mounted member in said passage having at least one straight bore nozzle therethrough said nozzle orientated in said member to rotate said member as a result of fluid flow through said nozzle;

said passage having an axis and said nozzle having a nozzle axis that is not parallel to said housing axis;

said nozzle axis does not intersect said housing axis;

said at least one nozzle comprises a plurality of nozzles disposed on at least one radius from a center of said member;

at least one of said nozzles has a nozzle axis substantially parallel or coincident with said axis of said passage over an entire length of said nozzle.

11. The assembly of claim 10, wherein:

said member comprises a plate with straight bores serving as said nozzles.

12. A subterranean fracturing nozzle assembly mounted to a string that delivers pressurized fluid to a formation to be fractured, comprising:

at least one housing having a passage therethough that is in fluid communication with the string;

a movably mounted member in said passage having at least one nozzle therethrough said nozzle orientated in said member to rotate said member as a result of fluid flow through said nozzle;

said passage having an axis and said nozzle having a nozzle axis that is not parallel to said housing axis;

said nozzle axis does not intersect said housing axis;

said at least one nozzle comprises a plurality of nozzles disposed on at least one radius from a center of said member;

at least one of said nozzles has a nozzle axis substantially parallel or coincident with said axis of said passage;

said member comprises a plate with bores serving as said nozzles;

said bores further comprising a hardened insert supported in said bore or on a side of said plate facing said passage.

13. A subterranean fracturing nozzle assembly mounted to a string that delivers pressurized fluid to a formation to be fractured, comprising:

at least one housing having a passage therethough that is in fluid communication with the string;

a movably mounted member in said passage having at least one nozzle therethrough said nozzle orientated in said member to rotate said member as a result of fluid flow through said nozzle;

said passage having an axis and said nozzle having a nozzle axis that is not parallel to said housing axis;

said nozzle axis does not intersect said housing axis;

said at least one nozzle comprises a plurality of nozzles disposed on at least one radius from a center of said member;

at least one of said nozzles has a nozzle axis substantially parallel or coincident with said axis of said passage;

said member comprises a plate with bores serving as said nozzles;

said passage comprises a device to impart spin to fluid passing said passage, said device supported by said plate.

14. A subterranean fracturing nozzle assembly mounted to a string that delivers pressurized fluid to a formation to be fractured, comprising:

at least one housing having a passage therethough that is in fluid communication with the string;

a movably mounted member in said passage having at least one nozzle therethrough said nozzle orientated in said member to rotate said member as a result of fluid flow through said nozzle;

said passage having an axis and said nozzle having a nozzle axis that is not parallel to said housing axis;

said nozzle axis does not intersect said housing axis;

a stationary plate supported by said housing and mounted adjacent to said member and having a plurality of openings.

15. The assembly of claim 14, wherein:

said openings are larger than said nozzles.

16. The assembly of claim 15, wherein:

the axes of said openings are substantially parallel or coincident with the axis of said housing.

17. A subterranean fracturing nozzle assembly mounted to a string that delivers pressurized fluid to a formation to be fractured, comprising:

at least one housing having a passage therethough that is in fluid communication with the string;

a movably mounted member in said passage having at least one nozzle therethrough said nozzle orientated in said member to rotate said member as a result of fluid flow through said nozzle;

said passage having an axis and said nozzle having a nozzle axis that is not parallel to said housing axis;

said nozzle axis does not intersect said housing axis;

said at least one nozzle comprises a plurality of nozzles disposed on at least one radius from a center of said member;

at least one of said nozzles has a nozzle axis substantially parallel or coincident with said axis of said passage;

said member comprises a plate with bores serving as said nozzles;

said housing having multiple components to allow said member to move radially away from the string and toward the formation.

18. The assembly of claim 17, wherein:

said component are relatively movable in a single direction.

19. The assembly of claim 16, wherein:

said housing having multiple components to allow said member to move radially away from the string and toward the formation.

20. The assembly of claim 19, wherein:

said component are relatively movable in a single direction.

* * * * *